United States Patent [19]

Maximov et al.

[11] Patent Number: 4,702,069

[45] Date of Patent: Oct. 27, 1987

[54] OPEN-END SPINNING DEVICE

[75] Inventors: Gennady K. Maximov; Arkady F. Brusnikin; Vladimir I. Belonosov; Roza A. Popova; Vladimir S. Fux; Vladimir M. Kagan; Silvia L. Uralskaya; Nadezhda P. Orlova, all of Moscow, U.S.S.R.

[73] Assignee: Vsesojuzny Nauchnoissledovatelsky Institut Legkogo I Tekstilnogo Mashinostroenia, Moscow, U.S.S.R.

[21] Appl. No.: 24,718

[22] Filed: Mar. 11, 1987

[51] Int. Cl.[4] ..... D01H 7/885; D01H 1/135

[52] U.S. Cl. ..... 57/417; 57/414

[58] Field of Search ..... 57/400, 404, 405, 414–417, 57/352

[56] References Cited

U.S. PATENT DOCUMENTS

| | | | |
|---|---|---|---|
| 3,640,061 | 2/1972 | Landwehrkamp | 57/417 |
| 3,805,505 | 4/1974 | Schuster | 57/417 |
| 3,844,100 | 10/1974 | Croasdale et al. | 57/417 |
| 3,875,731 | 4/1975 | Khomyakov et al. | 57/417 |
| 3,965,661 | 6/1976 | Yoshida | 57/417 |
| 4,258,541 | 3/1981 | Le Chatelier et al. | 57/417 |
| 4,499,719 | 2/1985 | Faessler | 57/417 |
| 4,516,397 | 5/1985 | Raasch et al. | 57/417 |
| 4,610,134 | 9/1986 | Busch et al. | 57/417 |

FOREIGN PATENT DOCUMENTS

| | | | |
|---|---|---|---|
| 515844 | 8/1976 | U.S.S.R. | 57/417 |

*Primary Examiner*—John Petrakes

*Attorney, Agent, or Firm*—Fleit, Jacobson, Cohn & Price

[57] ABSTRACT

An open-end spinning device has a driven spinning chamber and an outlet tube mounted coaxially with the spinning chamber. A projection is provided on the inner curvilinear surface of the outlet tube, the projection extending along a spiral uncoiling in the direction towards the spinning chamber. The configuration of the projection spiral is chosen in such a manner that the projection of the angle formed between a tangent line to the spiral and a line drawn at right angles to the longitudinal axis of the outlet tube on an imaginary plane drawn at right angles to the longitudinal axis of the outlet tube in the zone of a portion of the spiral most distant from the spinning chamber is between 30° and 40° which corresponds to the angle of turns of the yarn produced in the spinning chamber.

3 Claims, 5 Drawing Figures

OPEN-END SPINNING DEVICE

FIELD OF THE ART

The invention relates to the spinning equipment, and in particular, it deals with an open-end spinning device to be used in air-vortex spinners.

BACKGROUND OF THE INVENTION

Diameter of spinning chambers should be reduced, e.g. to 70 mm so as to achieve a substantial improvement of output of air-vortex spinners by increasing speed of the spinning chambers.

This results in a substantial increase in yarn breakage. To normalize the spinning process, it is necessary to shift twisting to the area of yarn formation so as to strengthen this area and to break-up rigidity triangles that prevent twisting from being shifted. The formation of such triangles becomes more likely with a decrease in the chamber diameter, increase in fiber length and with worse separation of fibers, Efficiency of prior art devices is inadequate for providing the desired twist in the zone of yarn formation and strengthening.

Yarn may be strengthened in the zone of its formation by imparting false twist in this zone. Projections are provided in the oulet tube of the open-end spinning device for imparting false twist.

Thus, SU pat. application No. 515844 discloses an open-end spinning device wherein an outlet tube mounted coaxially with a driven spinning chamber has a projection of a varying cross-section extending along a spiral uncoiling in the direction towards the spinning chamber, the projection being provided on the inner surface of the tube. The projection is made of a round-section wire which is secured to the inner surface of the tube by any known means.

However, the configuration of the projection spiral cannot ensure efficient shift of twisting into the yarn formation zone within the spinning chamber. This is due to the fact that the spiral has a constant value of the projection of an angle formed between a tangent line to the spiral and a line drawn at right angles to the longitudinal axis of the outlet tube on a plane drawn at right angles to the longitudinal axis of the tube.

This substantially lowers efficiency of shift of twisting in the yearn since the angle of turns in the yarn changes when false twist appears.

We have found that the value of the abovementioned projection of the angle is more than 40° thus resulting in a less efficient penetration of the spiral projections into the yarn turns, i.e. the spiral would slip over the yarn without penetrating it so that the amount of false twist decreases.

With the wire diameters ensuring optimum conditions for its penetration into recesses between the yarn turns, the height of the projections above the funnel surface is so small that the yarn is not substantially separated from the funnel surface between the projections. The yarn is urged against the outlet tube surface between the projections by centrifugal forces and is subjected to crumpling so that the yarn cannot rotate about the longitudinal axis (this phenomenon is similar to the rolling friction). As a result, the yarn twist within the ballon zone is inadequate for normal spinning, and breakage increases.

With an increases in the wire diameter, conditions for penetration of the projection into the recesses between yearn turns are impaired so that the amount of shift of the twisting decreases. In addition, the thread is subjected to high shear and normal stresses in the zones of its fricitional engagement with the projections when it is bent at the projections, especially at points where the thread leaves the spiral and enters it, these stresses resulting in the destruction of thread structure and its crumpling.

SUMMARY OF THE INVENTION

It is an object of the invention to provide an open-end spinning device in which configuration of a spiral on the inner curvilinear of an outlet tube ensures reliable shift of twisting to the yarn formation area.

Another object of the invention is to improve quality of yarn.

With these and other objects in view, in an open-end spinning device in which an outlet tube mounted coaxially with a driven spinning chamber has on its inner curvilinear surface a projection of varying cross-section extending along a spiral uncoiling in the direction towards the spinning chamber, according to the invention, the configuration of the spiral is chosen in such a manner that the projection of an angle formed between a tangent line to the spiral and a line drawn at right angles to the longitudinal axis of the outlet tube on an imaginary plane drawn at right angles to the longitudinal axis of the outlet tube in the zone of a portion of the spiral most distant from the spinning chamber is between 30° and 40°, the value of this angle gradually increasing as the spiral uncoils.

The projection is preferably of a rounded shape in the axial section of the outlet tube, the radius of this rounded shape decreasing in the direction of uncoiling of the spiral, or it may be triangular in shape, one side of the triangle extending in parallel with the longitudinal axis of the outlet tube and the outer side extending at right angles to this axis.

The invention ensures penetration of the spiral projection into a recess between turns of the yarn forming during twisting. The spiral ridge tends to unwind the turn of the yarn thus enhancing the shift. of twisting. As yarn tension decreases in the zone between the outlet opening of the outlet tube and its periphery, and engagement of yarn with the spiral becomes weaker, the decrease in the radius of the spiral projection in the direction of its uncoiling results in an increase in specific pressure exerted by the spiral projection on the yarn improving efficiency of action.

The provision of triangular spiral projections with one facet extending in parallel with the longitudinal axis of the funnel and the other facet extending at right angles to this axis ensures easy and reliable penetration of the spiral projection between turns of the yarn of any structure: continuous, overlapping, discontinuous.

In addition, this configuration of the projections makes it possible on the one hand to provide the projections which are high enough to separate the yarn from the outlet tube surface thereby reducing its crumpling under the action of centrifugal forces which hamper yarn rotation about its longitudinal axis; on the other hand, optimum conditions can be provided for penetration of the projections into recesses between turns of the yarn.

BRIEF DESCRIPTION OF THE DRAWINGS

The invention will now be described with reference to specific embodiments illustrated in the accompanying drawings, in which.

DESCRIPTION OF EMBODIMENTS

Figure 1:
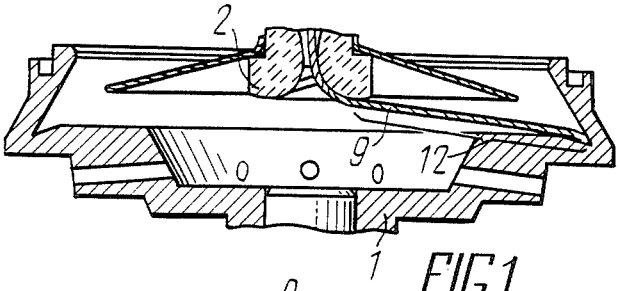
FIG. 1 schematically shows a longitudinal section view of an open-end spinning device according to the invention.

An open-end spinning device comprises a driven spinning chamber 1 (FIG. 1) of a known type and an outlet tube 2 mounted on the chamber coaxially therewith as shown in FIG. 1.

One or several projections 4 are provided in the outlet tube 2 (FIG. 2), on the inner curvilinear surface thereof, which extend along spirals 5 uncoiling in the direction towards the spinning chamber 1, i.e. towards the periphery of the tube. Configuration of each spiral 5 (FIG. 3) is chosen in such a manner that the projection of an angle $\alpha$ formed between a tangent line 6 to the spiral 5 and a line 7 drawn at right angles to the longitudinal axis O—O of the tube 2 on an imaginary plane A drawn at right angles to the axis O—O of the tube in the zone of a portion B of the spiral most distant from the spinning chamber is between 30° and 40°.

This is the angle of turns 8 (FIG. 2) of yarn 9 formed in the rotary spinning chamber. The projection of the angle $\alpha$ of the spiral increases gradually to values $\alpha$ (not to exceed 90°) in the direction towards the spinning chamber, i.e. as the spiral 5 uncoils.

The configuration of the spiral which is obtained with such a projection of the abovementioned angle may be different since it depends on the radius of curvature of the inner surface of the tube.

Figure 2:
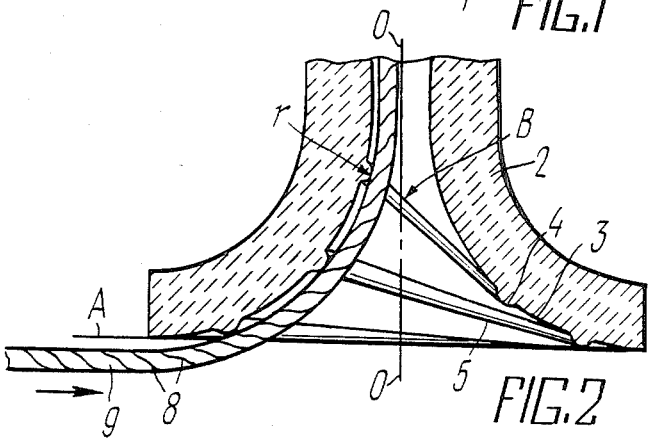
FIG. 2 is an enlarged partial view of an outlet tube.
Figure 3:
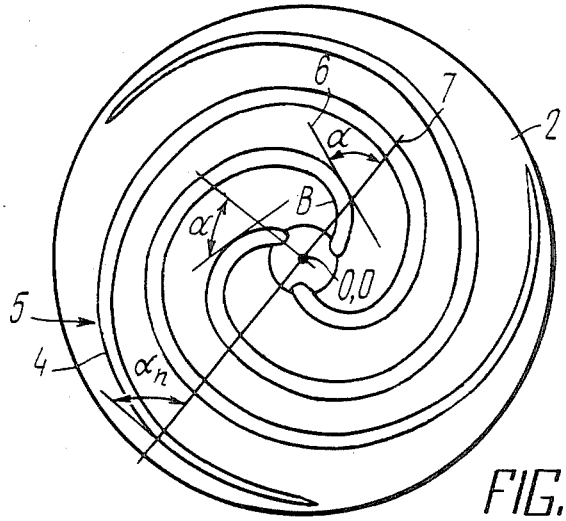
FIG. 3 is a projection of spiral projections on an imaginary plane A.

The spiral projection 4 is rounded in shape in the axial section of the tube as shown in FIG. 2. The radius r of the rounded projection decreases in the direction of uncoiling of the spiral 5 as shown in FIG. 3.

Figure 4:
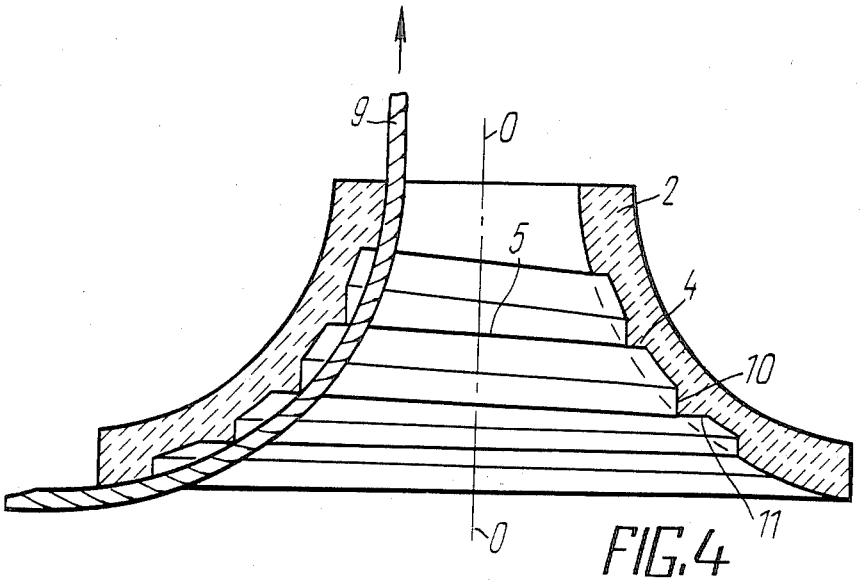
FIG. 4 is an embodiment of a projection.
Figure 5:
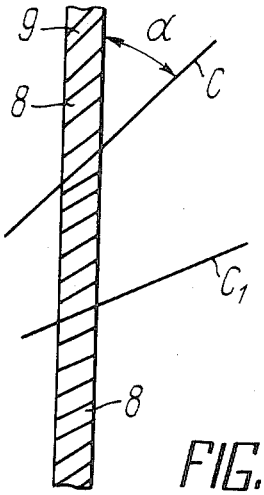
FIG. 5 schematically shows position of turns of yarn during engagement with a projection.

In the embodiment shown in FIG. 4, the spiral projection 4 is triangular in shape in the axial section of the tube one side 10 of the triangle extending in parallel with the axis O—O of the tube 2 and the other side 11 extending at right angles thereto. During operation of the open-end spinning device, the yarn 9 formed in a known manner in the spinning chamber 1 (FIG. 1) engages at the outlet ofthe chamber the projections 4 of the outlet tube 2 so that the latter will penetrate between the turns 8 and will contribute to the shift of twisting into a zone 12 of yarn formation in the spinning chamber (FIG. 1) where it has the lowest density. Owing to the arrangement of the projections 4 along a spiral having a configuration determined by the abovementioned angle the projections easily penetrate the yarn in the recesses between the turns 8. With an increase in the angle of spiral from $\alpha$ to $\alpha_n$ the area of contact between the projection and the yarn decreases so that pressure between the yarn and projection increases respectively. The projection 4 tends to unwind the turn of the yarn so as to enhance the shift of twisting (as schematically shown in FIG. 5 where the areas of engagement are shown at C and $C_1$).

The decrease in the radius r of roundness of the projections in the direction of uncoiling of the spiral also contributes to the efficient action of the projections upon yarn.

After penetration of the spiral projection between the turns of the yarn, false twist formation is started in the area of the yarn upstream the projection so that the angle of turns somewhat increases. As the angle of spiral also gradually increases as the spiral uncoils, the effective engagement of the spiral projection with the yarn is ensured so as to retain the false twist thus imparted and to strengthen the yarn in the area 12 of its formation.

What is claimed is:

1. An open-end spinning device, comprising: a driven spinning chamber; an outlet tube mounted coaxially with said spinning chamber and having a curvilinear inner surface of a varying cross-section; a projection provided on the inner curvilinear surface of said outlet tube along a spiral uncoiling in the direction towards said spinning chamber; the configuration of the spiral of said projection being chosen in such a manner that the projection of an angle formed between a tangent line to the spiral and a line drawn at right angles to the longitudinal axis of the tube on an imaginary plane drawn at right angles to the longitudinal axis of the tube in the zone of a portion of the spiral most distant from said spinning chamber being between 30° and 40°, the angle gradually increasing as the spiral uncoils.

2. A device according to claim 1, wherein said projection is of a rounded shape in the axial section of said outlet tube, the radius of this shape decreasing in the direction of uncoiling of the spiral.

3. A device according to claim 1, wherein said projection is triangular in shape in the axial section of said outlet tube, one side of the triangle extending in parallel with the longitudinal axis of the tube and the other side extending at right angles to this axis.

* * * * *